US007832703B2

(12) United States Patent
Schmidgall et al.

(10) Patent No.: US 7,832,703 B2
(45) Date of Patent: Nov. 16, 2010

(54) APPARATUS AND METHOD FOR PROTECTING LINED CONCRETE PIPE DURING THE MANUFACTURING PROCESS

(75) Inventors: Jon A. Schmidgall, Mediapolis, IA (US); David E. Stoller, Burlington, IA (US)

(73) Assignee: Hawkeye Concrete Products Co., Mediapolis, IA (US)

( * ) Notice: Subject to any disclaimer, the term of this patent is extended or adjusted under 35 U.S.C. 154(b) by 0 days.

(21) Appl. No.: 12/351,554

(22) Filed: Jan. 9, 2009

(65) Prior Publication Data

US 2010/0178373 A1 Jul. 15, 2010

(51) Int. Cl.
*B22C 9/24* (2006.01)

(52) U.S. Cl. ..... 249/144; 249/146; 249/148; 249/207; 249/205; 249/83; 249/91; 249/93; 425/110; 425/117; 425/127; 425/472; 425/438

(58) Field of Classification Search ..... 249/144, 249/146, 148, 207, 205, 219.1, 83, 91, 93; 425/110, 117, 127, 472, 426, 432, 438
See application file for complete search history.

(56) References Cited

U.S. PATENT DOCUMENTS 3,900,179 A * 8/1975 Mocny et al. ..... 248/287.1
3,967,806 A * 7/1976 Strickland et al. ..... 248/287.1
4,708,621 A 11/1987 Schmidgall et al.
5,005,801 A * 4/1991 Giarrocco et al. ..... 249/211
5,522,579 A * 6/1996 Rock ..... 249/219.1
5,720,993 A 2/1998 Schmidgall

* cited by examiner

*Primary Examiner*—Khanh Nguyen
*Assistant Examiner*—Saeed M Huda
(74) *Attorney, Agent, or Firm*—James C. Nemmers; Shuttleworth & Ingersoll, PLC

(57) ABSTRACT

At the filling station of a dry cast pipe making machine for making pipe lined with a plastic liner, the liner is first placed over the core and then a plurality of spaced-apart, removable L-shaped plates are secured around the top edge of the core. One leg of each plate extends inside the core with the other leg extending downwardly over the top edge of the liner. The plates are removably held in place on the core by the use of a clamping device, such as a vise-grip, for example. Once the form is filled with concrete and ready for the pressure heading step, the downwardly extending legs of the plates serve as 'shoehorns' to guide the pressure header over the top of the liner and prevent damage to it. In addition, the plates will assist in centering the core within the jacket.

8 Claims, 6 Drawing Sheets

APPARATUS AND METHOD FOR PROTECTING LINED CONCRETE PIPE DURING THE MANUFACTURING PROCESS

BACKGROUND OF THE INVENTION

This invention relates to machines for producing concrete pipe and other similar concrete products.

There are known and used in the industry numerous designs of machines for producing concrete pipe and other similar products. Some of these machines are single station machines, while others are multiple station machines. The latter type machines generally have three stations at which the basic cycles of filling, pressure-heading and stripping are simultaneously performed. At the first station, a jacket with a removable pallet secured to its lower end is lowered over a core, creating an annular space between the core and jacket which is then filled with concrete at the filling station. At the pressure heading station, a pressure head is lowered onto the top of the form to compact the concrete. At the third station, the jacket and pallet together with the now-formed concrete pipe is stripped form the core and moved to the curing area. The jacket is then released from the pallet and lifted from the now-formed pipe. A new pallet is then added to the jacket and the form is returned to the filling station and lowered over the core. The common technique for making concrete pipe is known as dry cast which produces a pipe of excellent quality at much higher production rates than the wet cast process. In dry cast, a dry mix is compacted and the pipe is removed promptly after the concrete is set but before the concrete is completely cured. An example of dry cast techniques used in making concrete pipe is shown in Schmidgall et al U.S. Pat. No. 4,356,628.

Concrete pipe are sometimes manufactured with a plastic liner that provides increased resistance to corrosion and deterioration from various chemicals in and gases emitted from liquids flowing through the pipe. The plastic material used for lining concrete pipe is extruded in a sheet form and is typically provided with T-shaped ribs that project outwardly from one side. These T-shaped ribs become embedded in the concrete during the pipe making process, and when the concrete is set, an excellent bond is created between the liner and the finished pipe. However, it is not uncommon for the T-shaped ribs of the liner to pull out away from the concrete during the casting process. This occurs in the dry cast process because the concrete is set but not completely cured when the product is stripped from the core. Not infrequently, this results in a bulge or pullout because of the friction that is created between the liner and the core when the core is removed. Moreover, when the dry cast process takes place using a rigid non-collapsing shape of core, it is also difficult to place the liner over the core because the liners are large and flexible and pre-formed into a tube that must fit tightly over the core. In an attempt to overcome the problems of pullout and bulging in the plastic liner that may occur when a rigid non-collapsible core is used, collapsible and expandable inner cores have been developed and are typically used in the dry cast method. When collapsible cores are used, the core is collapsed to allow the liner to more easily be placed over the core after which the core is expanded and the pipe is cast. The core is then collapsed to permit easy removal of the finished concrete pipe. An example of a pipe making machine for making lined pipe using a collapsible core of this type is shown in Schmidgall U.S. Pat. No. 5,720,993.

At the present time, the core is placed on a pallet at a setup area, and the plastic liner is manually placed over the core. The jacket is then lowered over the core with the liner in place.

Then, this core-pallet-jacket module is transported to the pipe making machine to be filled with concrete. After being filled with concrete, the module is moved to the pressure heading station, where the pressure header is lowered to compact the concrete. As this step in the process is performed, the header will bear against the core to center it with respect to the jacket. However, during this pressure heading step, it is possible for the header to snag the plastic liner, and as the header is moved into position, the header may also scrape against the liner and damage it. If the damage is not repaired, the pipe will be defective, because when the pipe sections are assembled in the field, the interior concrete surface of the pipe at the point of the damage will be exposed to the chemicals in the liquid flowing through the pipe. Therefore, the damage must be repaired manually by hot air welding a plastic patch over the damaged area. Obviously, this type of repair is a time consuming and difficult process because a worker has to work inside the pipe to make the repair. In producing pipe with plastic liners, some pipe manufacturers use the same standard-size headers that are designed for producing pipe without plastic liners. In this case, the liner is not contacted by the header and must be cut short since the inside diameter of the header is too small to pass over the liner. When lined pipe produced in this manner are installed in the field, there is a gap in the liner where two sections of pipe are joined. This gap must be covered by a wide annular band of plastic that is hot-air welded around both edges of the liners of the adjoined pipe sections. This is a difficult job because a worker now has to crawl inside the pipe to the area where two sections are joined and apply the band. To make this job easier, many manufacturers will use headers having an inside diameter large enough to slip over the liner, the end of which will now extend through the header and beyond leaving a flap of the liner long enough to extend over the liner of an adjoining pipe section when they are assembled in the field. Although the liner must still be hot-air welded along one edge, the flap eliminates the necessity of an annular band requiring two edges to be welded to adjoining pipe sections. However, because the header must now pass over the end of the liner during the pressure heading step, the header must be guided over the liner to prevent snagging with resulting damage to the liner. At the present time, the header is guided over the liner by two or more production workers each using a tool, such as a trowel, to guide the header. Obviously, this requires additional labor and slows down the pipe making process. Therefore, there is a need for an improved way of protecting the liner from damage during the pressure heading step in the pipe making process.

It is therefore the principal object of the invention to provide a method and structure for protecting the plastic pipe liner during the pressure heading step of making the pipe, and thereby produce a finished product of higher quality while also increasing the productivity of the pipe making process and reducing the cost of producing the pipe.

SUMMARY OF THE INVENTION

The machine of the invention accomplishes the foregoing object by adding at the filling station the plastic liner and then putting in place a plurality of spaced-apart, removable L-shaped plates around the top edge of the core, one leg of the plates extending inside the core with the other leg extending downwardly over the top edge of the liner. The plates are removably held in place by use of a clamping device, such as a vise-grip, for example. During the pressure heading step, the downwardly extending legs of the plates serve as 'shoehorns' to guide the pressure header over the top of the liner and prevent damage to it. In addition, the plates will assist in centering the core within the jacket. When the pressure heading step is completed, a flap at the end of the liner will extend beyond the header, and when the pipe sections are assembled in the field, the flap will overlap the liner in the adjoining pipe section and simplify the completion of the joint. The pipe making machine of the invention thus provides for minimizing damage to the pipe liner during the pipe making process and simplifies the process resulting in increased production output with no increase in manpower. The invention also provides for easy adaptation of existing machines to utilize the features of the invention.

DESCRIPTION OF THE PREFERRED EMBODIMENT OF THE INVENTION

Figure 1:
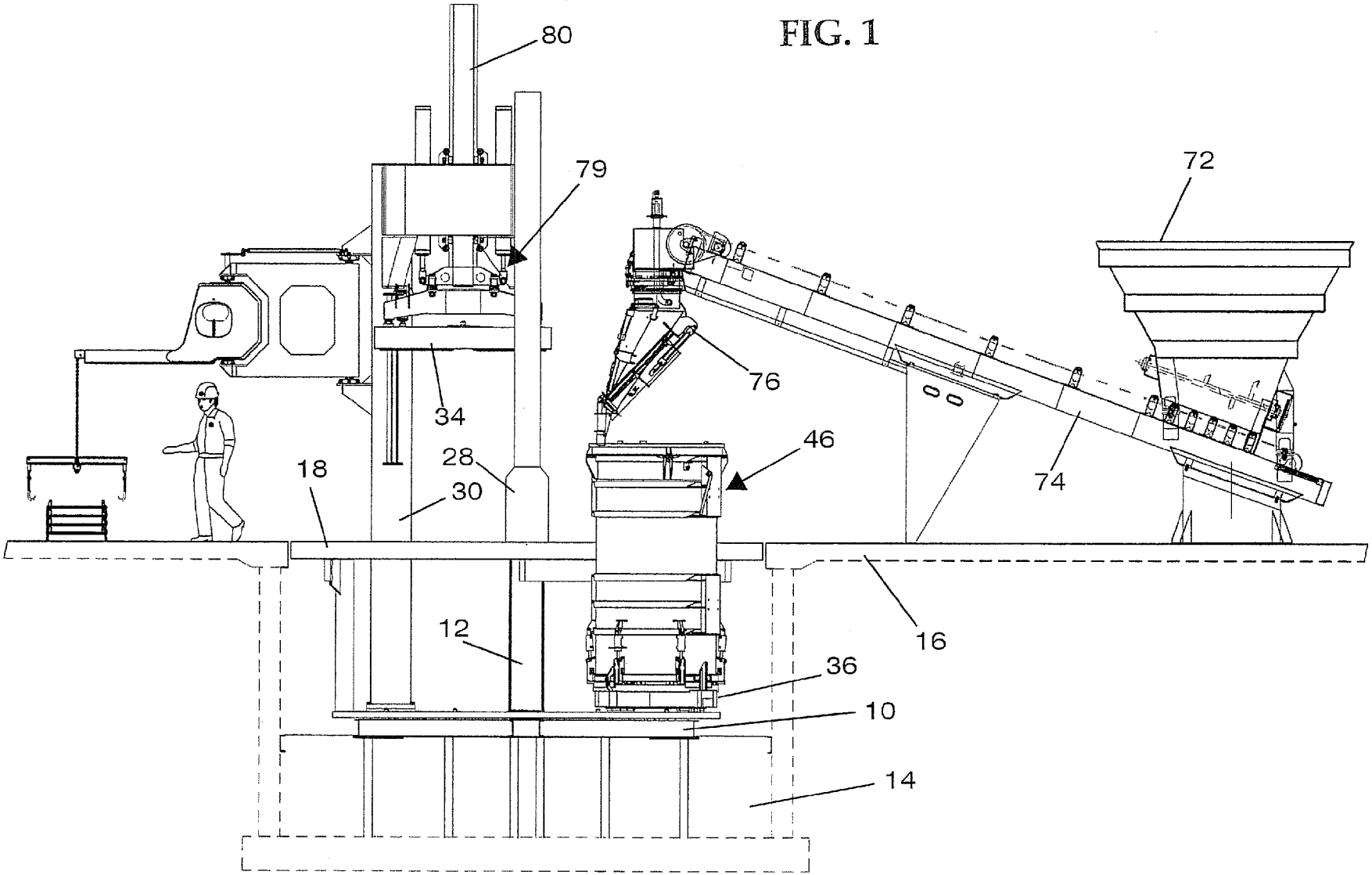
FIG. 1 is a side elevational view, showing a typical pipe making machine that can utilize the principles of the invention.
Figure 2:
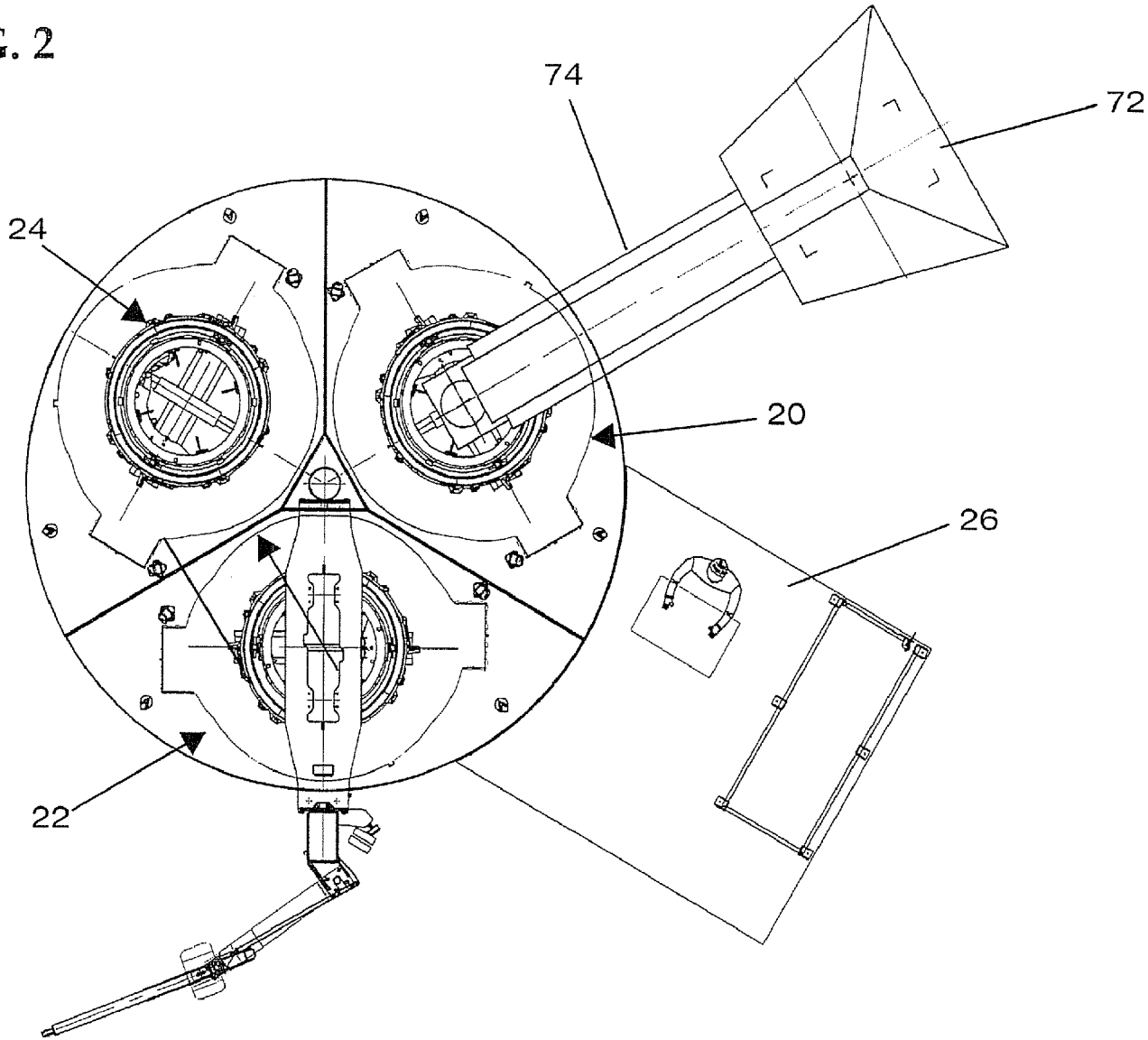
FIG. 2 is a top or plan view of the machine of FIG. 1 and illustrating the three stations for performing the steps of the pipe making operation.

In the drawings, there is shown a typical pipe making machine of the dry cast type. The machine shown is a multi-station machine in which a form set is moved by a turntable around the three stations where the pipe making process takes place. However, it should be understood that the form set can be stationary and the equipment for carrying out the process moved over the form set in proper sequence. Referring now to the drawings, and particularly to FIG. 1 and FIG. 2, the operating stations of the machine are spaced around a turntable 10 mounted for rotation about a central support 12 in a pit 14 formed below the level of the floor 16. The pit 14 is usually covered with a removable cover 18 which has a plurality of openings in it and through which extend the forms that will be described in detail hereinafter. Cover 18 is supported by and rotatable with turntable 10 in any suitable manner as is well known with existing conventional multi-station machines of this type.

As best seen in FIG. 2, the machine has a fill station 20, a pressure-head station 22 and an offbear or stripping station 24. The machine also preferably includes an operator station 26 at which the controls are centralized so that one man can control operation of the machine. The machine also includes a main vertical support 28 (FIG. 1) and a side vertical support 30 that are interconnected to provide the necessary supporting structure for the pressure head unit 79 which is vertically movable at the pressure-head station 22. The pressure head function will be described in more detail hereinafter since the invention relates primarily to what occurs at the pressure head station 22.

In addition to the foregoing components, as is well known to those skilled in the art, the complete pipe making machine has an overhead beam supported on a suitable overhead tram (not shown) so that the beam can be moved up and down and to different positions. This provides for placement of a form set in the filling station 20 and then removing it from the offbear station 24 and transferring it to a curing area.

Figure 3:
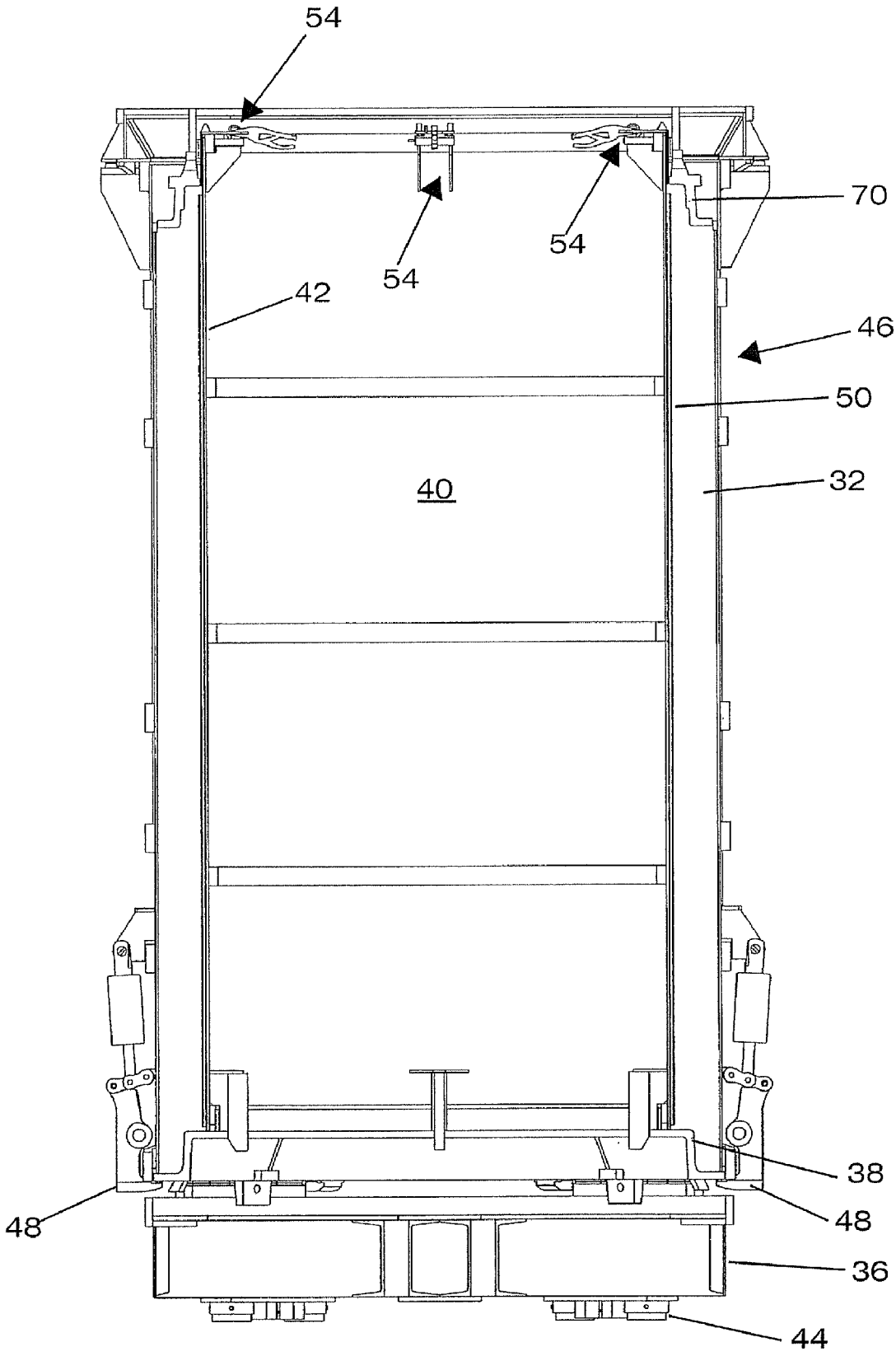
FIG. 3 is a sectional view through an elevation of a form set shown at the pressure heading station and showing the jacket, pallet, core and base.
Figure 4:
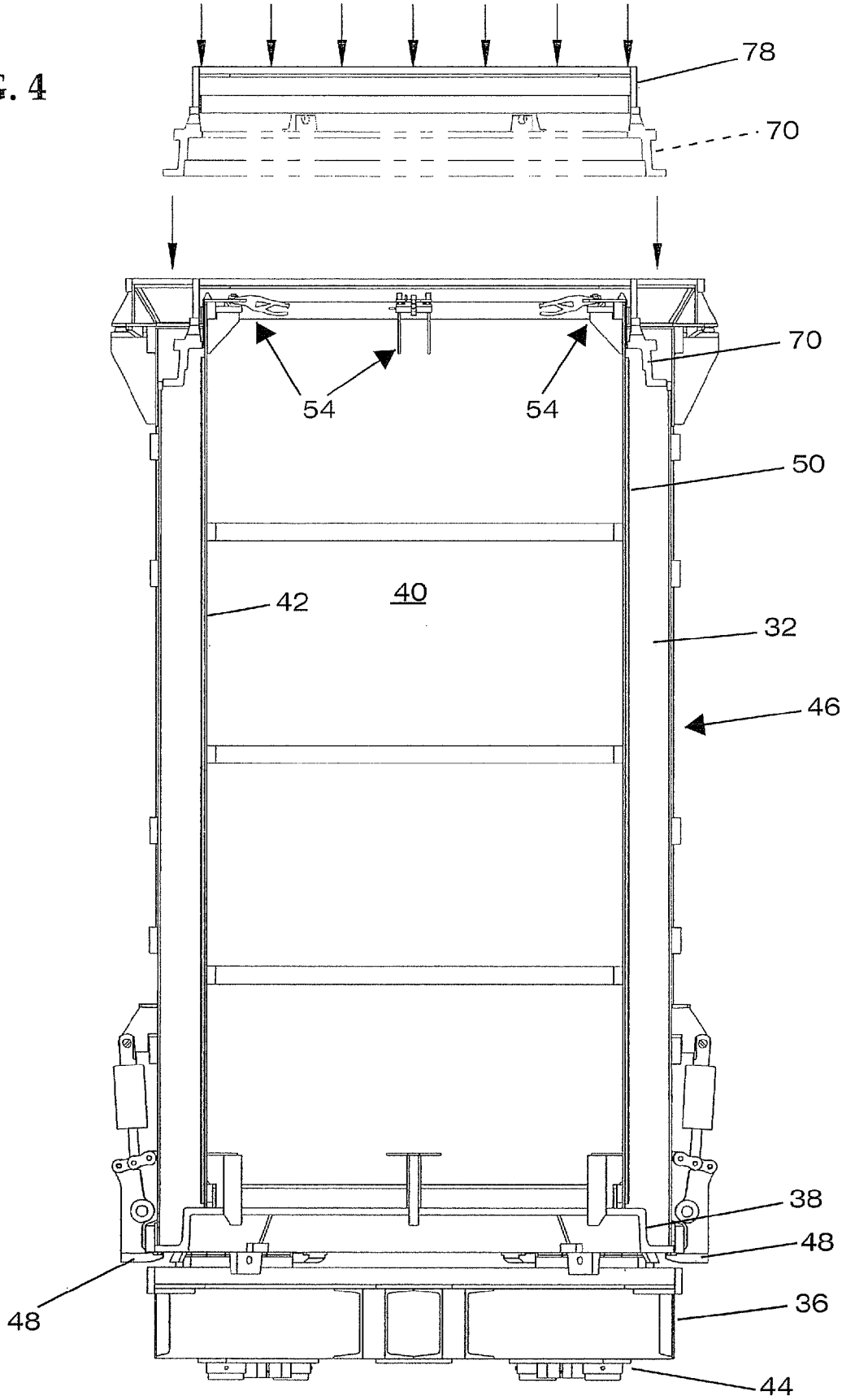
FIG. 4 is a view similar to FIG. 3 and illustrating the pressure header being lowered in place on top of the-form set.
Figure 5:
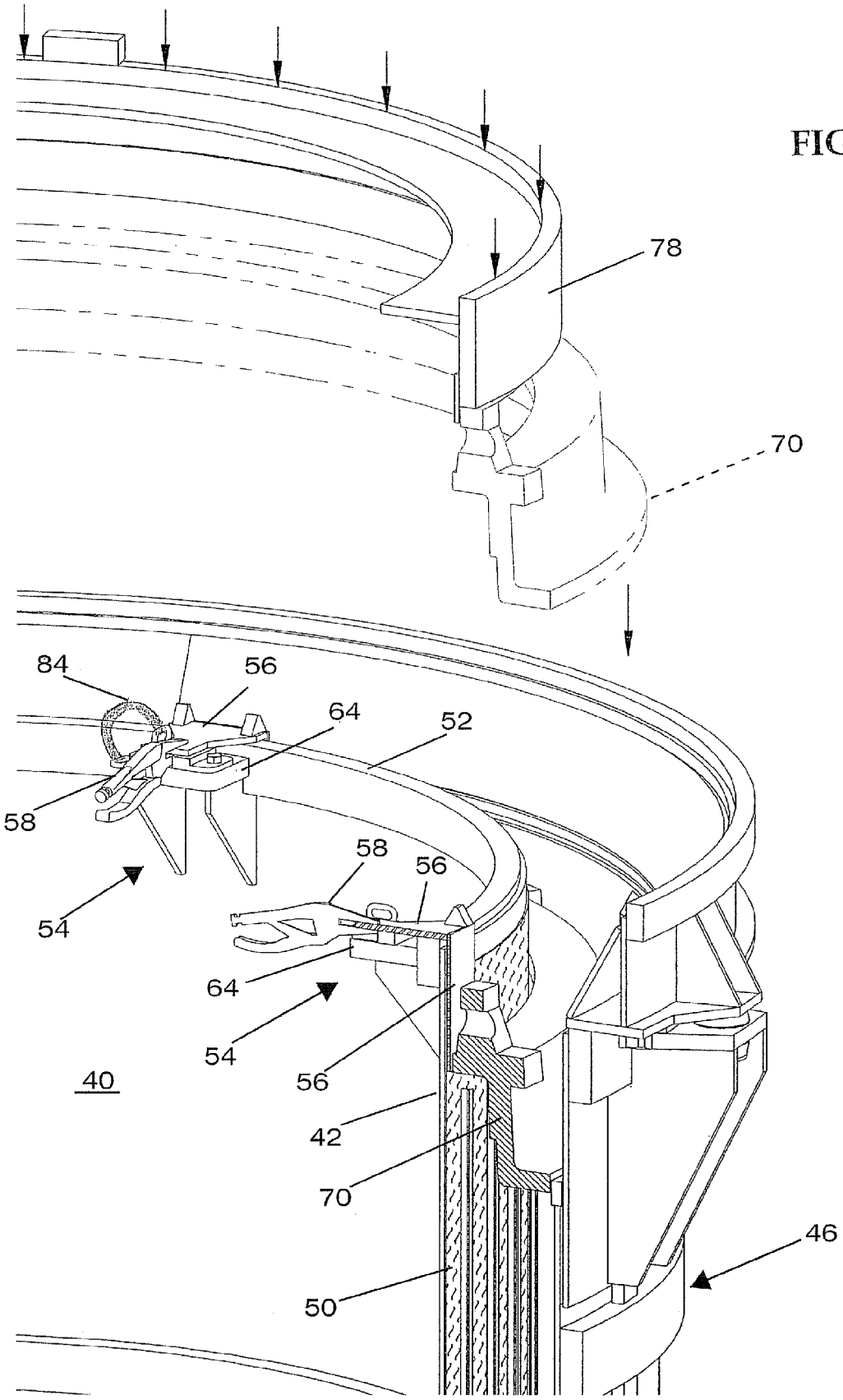
FIG. 5 is a perspective view of a portion of the top of a form set showing the L-shaped plates and clamping devices around the top of the core and illustrating the header being lowered onto the form set.
Figure 6:
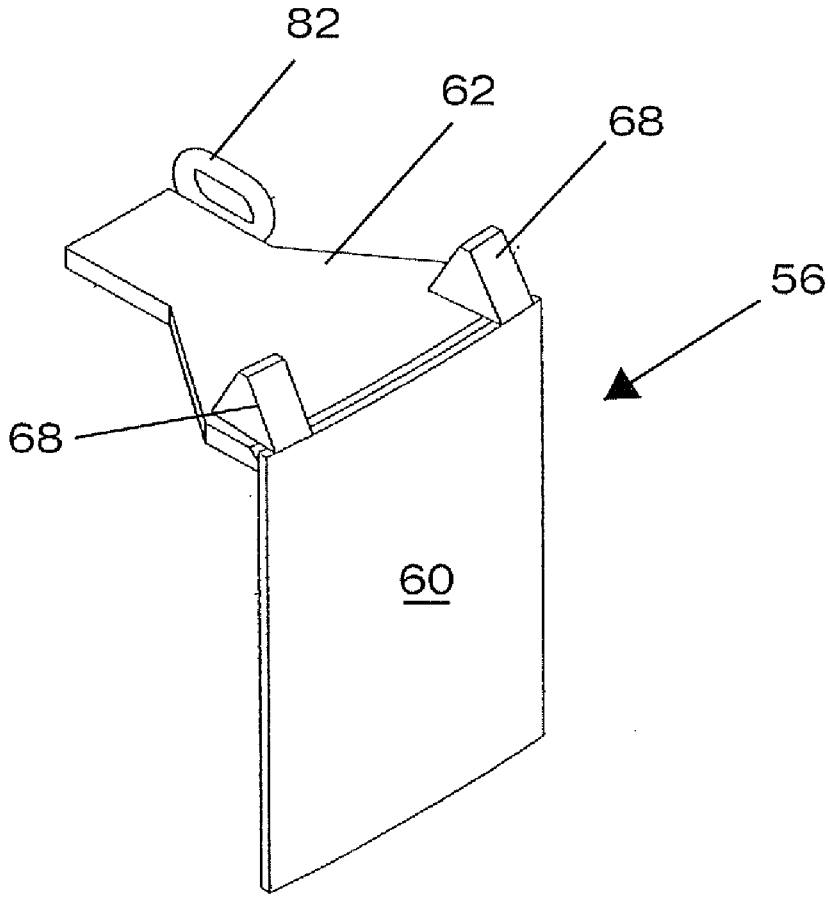
FIG. 6 is a perspective view of the L-shaped plate.
Figure 7:
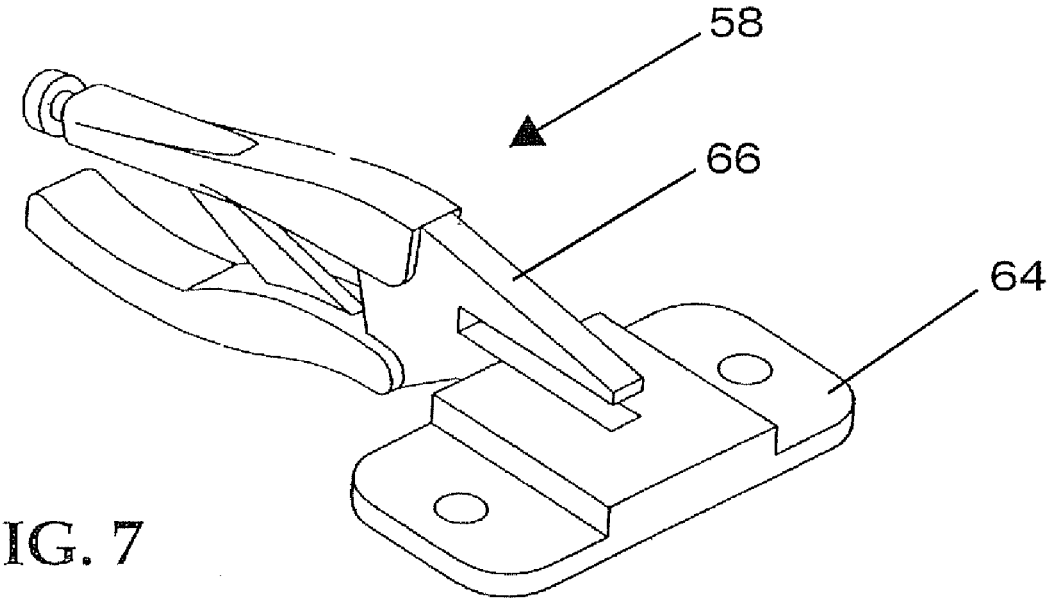
FIG. 7 is a perspective view of the clamping device.

Referring now to FIGS. 3, 4 and 5 as well as FIG. 1, the structure of a form set and related supporting structure will now be described. Each form set has a suitable supporting base 36 which rests directly upon the turntable 10. Suitable means (not shown) can be provided to secure the base 36 to the turntable so that it will rotate with it. The base 36 is provided with a plurality of rubber isolators 44 secured beneath it and which rest directly upon the turntable 10. The form set, when completed as described hereinafter, is thus not rigidly affixed to the turntable 10 so that the form set, after being filled with concrete, is free to be vibrated in a manner well know to those skilled in the art.

As is well known to those skilled in the art, in most instances, a setup area is provided where a wire cage of reinforcing steel (not shown) is first positioned around the core 40 which is resting on a pallet 38. Each core 40 consists of a vertical cylindrical tube 42 that is preferably hollow. When producing lined pipe, collapsible cores are used which allows a plastic liner 50 to more easily be placed over the tube 42 of the core 40 after which the tube is expanded and the pipe is cast. An example of a collapsible core for a pipe making machine for making lined pipe is shown in Schmidgall U.S. Pat. No. 5,720,993. With the core 40 resting on the pallet 38 and in a collapsed condition inside the wire cage, the plastic liner 50 is then manually placed over the core 40 and the core 40 is expanded.

Referring now to FIGS. 4, 5, 6, and 7, there is shown in FIG. 5 a part of the top portion of a core 40 with the liner 50 in place. Along the top edge 52 of the core 40 are positioned a plurality of 'shoehorn' devices, each indicated generally by the reference numeral 54. While the form set is still in the setup area, the devices 54 are affixed to the top edge 52 of each core 40 with the liner 50 in place around the core 40. Each device 54 is comprised of a removable L-shaped plate 56 and a clamping device 58. Each L-shaped plate 56 has a downwardly extending leg 60 that extends over the top of the plastic liner 50 that has been positioned over the core 40. Each L-shaped plate 56 also has an inwardly extending leg 62 that is held in place on the base 64 of the clamping device 58. The base 64 is permanently affixed in any suitable manner, such as by welding, to the inside of the core 40 and has affixed to it the clamping device 58 that has jaws 66 for releasably gripping the leg 62 of the L-shaped plate 56. The clamping device 58 illustrated in the drawings is similar to the commonly known vise grip, but any suitable clamping device can be used to hold the plate 56 in place and allow it to be removed and reinstalled. The top edge of the L-shaped plate 56 also preferably has a pair of upwardly extending lugs 68 that have sloped edges. As described hereinafter, during the pressure heading step, the lugs 68 serve to guide the header 70 around the core 40 and over the plastic liner 50 so that the header 70 does not contact the liner 50 and damage it. The lugs 68 also serve to assist in centering the core 40 with respect to the jacket 46 when the header 34 is pressure headed onto the core 40. The core 40, with liner 50 covering it and the shoehorn devices 54 in place, is now in a position to receive the jacket 46 as now described.

A jacket, indicated generally by the reference numeral 46, is provided to complete the form set. Each jacket 46 is a hollow, generally cylindrical tube the inside diameter of which is greater than the outside diameter of the corresponding core 40 thus creating an annular space 32 between each jacket 46 and each corresponding core 40 that is the thickness of the wall of the pipe to be produced. As is customary with machines of this type, the jacket 46 is lowered over the core 40 and attached to the pallet 38. The attachment mechanism consists generally of releasable locking lugs 48 (FIG. 3) that engage the bottom of the pallet 38 and thus positively position the jacket 46 relative to the core 40 and thereby accurately determining the wall thickness of the concrete pipe. The pallet 38 also provides a part of the form that shapes the end of the pipe to the desired configuration. The completed form assembly or module consisting of jacket 46, the pallet 38 and core 42 with liner 50 is now ready to be filled with concrete, and the module is transported to the pipe making machine and positioned at the fill station 20.

At the fill station 20, there is provided a hopper 72 and a conveyor 74 at the outer end of which is a fill chute 76 that can be moved into position over the completed form set during the filling cycle. Once the module has been filled with concrete, it is moved by the turntable 10 to the pressure head station 22 of the pipe making machine.

Referring now to FIG. 1, there is shown the pressure-head extruder unit indicated generally by the reference numeral 79. This unit 79 is vertically-movable by a support 80, and unit 79 includes the pressure header 34 and also contains an annular shaped pressure header 70 that applies pressure to compact the concrete contained between the jacket 46 and core 40 (FIGS. 4 and 5). The pressure header 34 also contains an extension ring 78 that engages the header 70. As the pressure header 70 is lowered onto the top of the form, the lugs 68 and the legs 60 of the shoehorns 54 guide the header 70 to assure that the liner 50 is not damaged by contact with the header 70. The legs 60 of the shoehorns 54 each extend downwardly a sufficient distance to protect the liner 50 as the header 70 continues to move downwardly between the core 40 and the jacket 46 to compact the concrete. Contact of the header 70 with the lugs 68 and the legs 60 of the shoehorn devices 54 serves to guide the core 40 over to the center to assure that the finished pipe is of uniform thickness. As is well know to those skilled in the art, during the pressure-head cycle, vibrators (not shown) may be actuated so that the concrete is fully compacted to form a high quality pipe.

After the pressure heading step is completed, the turntable 10 is rotated to move the module to the off bearing and stripping station 24. The module, consisting of the pallet 38, core 42 and jacket 46 together with the product, is then transported to the curing area where the pallet 38 are released from its connection to the jacket 46, and the jacket 46 is then stripped from the now finished pipe and moved to the setup area for reuse. After an adequate time for the concrete pipe to set, the core 40 is collapsed and the jaws 66 of the clamping device 58 are released allowing removal of the L-shaped plates 56. Each plate 56 has a ring 82 (FIG. 6) to which is attached one end of a cable 84 (FIG. 5), the other end being attached to the base 64 of the clamping device 58. This allows the plates 56 to remain suspended inside of the core 40 for use in making the next pipe. The collapsed core 40 is then removed and transported to the setup area for reuse. The pipe will now sit in the curing area until the pipe is completely cured.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

What is claimed is as follows:

1. An apparatus for protecting a concrete pipe lined with a plastic liner during the manufacture of the pipe by a dry cast pipe making machine, said apparatus comprising:

a jacket and a hollow core providing a form for the lined concrete pipe, the core having a plastic liner in place around the outside of the core and the core having a top edge;

a plurality of spaced-apart, generally L-shaped plates adapted to be secured to the top edge of the core, each plate having legs with one leg extending inwardly inside the hollow core and with the other leg extending over the top edge of the liner and downwardly over the liner when the plates are secured to the core;

and a clamping device combined with each plate for removably securing the plates to the core during the manufacture of the lined pipe, the clamping devices being positioned inside the core.

2. The apparatus of claim 1 in which the clamping device includes a pair of jaws releaseably gripping the inwardly extending leg of the plate.

3. The apparatus of claim 1 in which the clamping device includes a base, the base being affixed to the inside of the core.

4. The apparatus of claim 1 in which each plate has a lug extending upwardly from the inwardly extending leg at the point where the inwardly extending leg is joined to the downwardly extending leg.

5. The apparatus of claim 4 wherein the inwardly extending leg of each plate contains two upwardly extending lugs, the two upwardly extending lugs spaced a distance apart from one another.

6. The apparatus of claim 1 wherein the inwardly extending leg of each plate is provided with a ring, and a cable is attachable to the ring and to the clamping device to retain the plate inside the core when the plate is not secured to the top edge of the core.

7. The apparatus of claim 1 wherein the clamping device comprises vise grips.

8. The apparatus of claim 1 wherein the base is permanently affixed to the core.

* * * * *